US008087124B2

(12) United States Patent
Wolfe, Jr.

(10) Patent No.: US 8,087,124 B2
(45) Date of Patent: Jan. 3, 2012

(54) VACUUM CLEANER AND DISPOSABLE VACUUM CLEANER BAG

(76) Inventor: Melvin E. Wolfe, Jr., Hallstead, PA (US)

( * ) Notice: Subject to any disclaimer, the term of this patent is extended or adjusted under 35 U.S.C. 154(b) by 1036 days.

(21) Appl. No.: 11/726,325

(22) Filed: Mar. 21, 2007

(65) Prior Publication Data

US 2007/0251049 A1 Nov. 1, 2007

Related U.S. Application Data

(60) Provisional application No. 60/784,880, filed on Mar. 22, 2006, provisional application No. 60/846,546, filed on Sep. 22, 2006.

(51) Int. Cl.
*A47L 9/10* (2006.01)
*B01D 46/10* (2006.01)

(52) U.S. Cl. ..... 15/347; 15/DIG. 2; 55/368; 55/381; 55/382

(58) Field of Classification Search ..... 15/347, 15/DIG. 8; 55/368, 381, 382, DIG. 2; 435/295.1; *A47L 9/10; B01D 46/10*
See application file for complete search history.

(56) References Cited

U.S. PATENT DOCUMENTS

| | | | | |
|---|---|---|---|---|
| 1,989,868 | A * | 2/1935 | Kessler | 55/368 |
| 3,245,605 | A | 4/1966 | Meyerhoefer et al. | |
| 3,440,805 | A | 4/1969 | Cordell et al. | |
| 4,675,032 | A * | 6/1987 | Genovese et al. | 95/282 |
| 4,885,013 | A * | 12/1989 | Ahlf et al. | 55/367 |
| 5,784,757 | A | 7/1998 | Cipolla | |
| 6,348,078 | B1 * | 2/2002 | Crismore | 55/361 |
| 6,379,408 | B1 * | 4/2002 | Embree et al. | 55/361 |
| 6,381,804 | B1 | 5/2002 | Paterson et al. | |

FOREIGN PATENT DOCUMENTS

| | | |
|---|---|---|
| EP | 1 068 828 | 1/2001 |
| WO | WO 93/21812 | 11/1993 |

OTHER PUBLICATIONS

International Search Report for International Application No. PCT/US2007/064386, dated Aug. 22, 2007.
Written Opinion for International Application No. PCT/US2007/064386, dated Aug. 22, 2007.
International Preliminary Report on Patentability for International Application No. PCT/US2007/064386, dated Sep. 23, 2008.

* cited by examiner

*Primary Examiner* — David Redding
(74) *Attorney, Agent, or Firm* — Marshall, Gerstein & Borun LLP; Robert M. Gerstein; Richard M. LaBarge

(57) ABSTRACT

The disclosed disposable vacuum cleaner has a disposable bag with a collar at the bottom, rather than on the sides. Dirty air enters the bag vertically, rather than horizontally, through a duct that is positioned near the floor, separate from the handle on the vacuum cleaner. An elongated, light-weight tube is disposed within the bag, and has a lower end that is connected to the collar. The tube is made of a thin, light-weight, lay-flat tubing with opposed creases, and is flexible and collapsible. It has a length that is greater than half the height of the sides of the bag. The collar has a seal that is trapped between two pieces of mounting material and extends around the periphery of the duct, providing an elastic seal. The bag has a top that is reinforced with a cardboard support. Extending flanges on the support can be used to suspend the bag from arms in the vacuum cleaner.

9 Claims, 9 Drawing Sheets

VACUUM CLEANER AND DISPOSABLE VACUUM CLEANER BAG

FIELD OF THE DISCLOSURE

This disclosure generally relates to vacuum cleaners, and more particularly to disposable dust bag arrangements for vacuum cleaners.

Vacuum cleaners are common appliances for commercial and residential floor care. A wide variety of vacuum cleaner configurations, including upright vacuums, canister models, and hand-held models, are available to suit the needs of a particular application or user.

Vacuum cleaners remove dirt from a carpet by creating a suction that is strong enough to draw dirt and other small particles into the vacuum cleaner. Commonly, the dirty air is directed to a disposable vacuum bag that collects the entrained dirt.

A conduit is often used to guide the dirty air from the cleaning head of the vacuum cleaner to the bag. The conduit sometimes runs up or through a handle assembly. In cases where the conduit is rigid, the conduit itself can serve as a portion of the handle. Dirty air generally exits the conduit through a duct that angles off the conduit into an upper portion of the bag.

Vacuum bags are commonly made from porous material, such as porous paper, that traps most dirt particles as the air flows through the material. The trapped dirt falls to the bottom of the bag, where it collects. The bag is generally closed except for a collar that fits closely over the duct. Because the disposable bag is fragile, it is commonly housed within a protective outer bag or cover.

DETAILED DESCRIPTION

Figure 1:
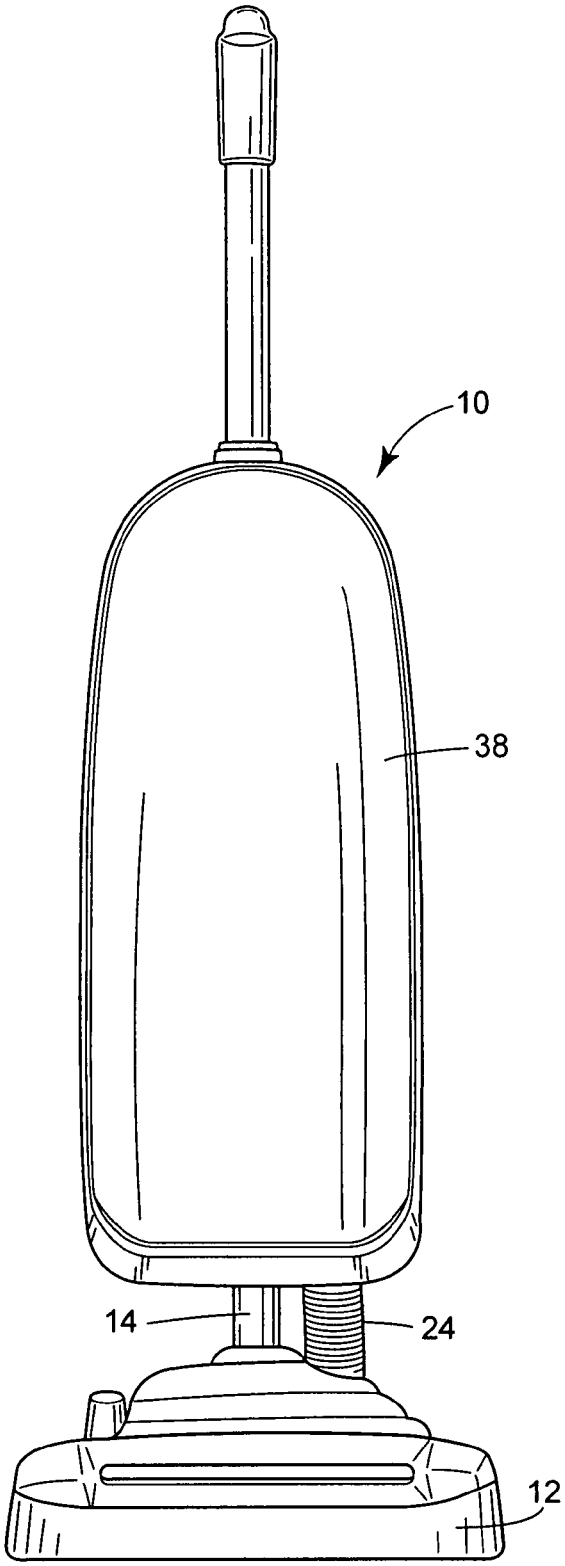
FIG. 1 is a front view of one type of vacuum cleaner that incorporates the new invention.
Figure 2:
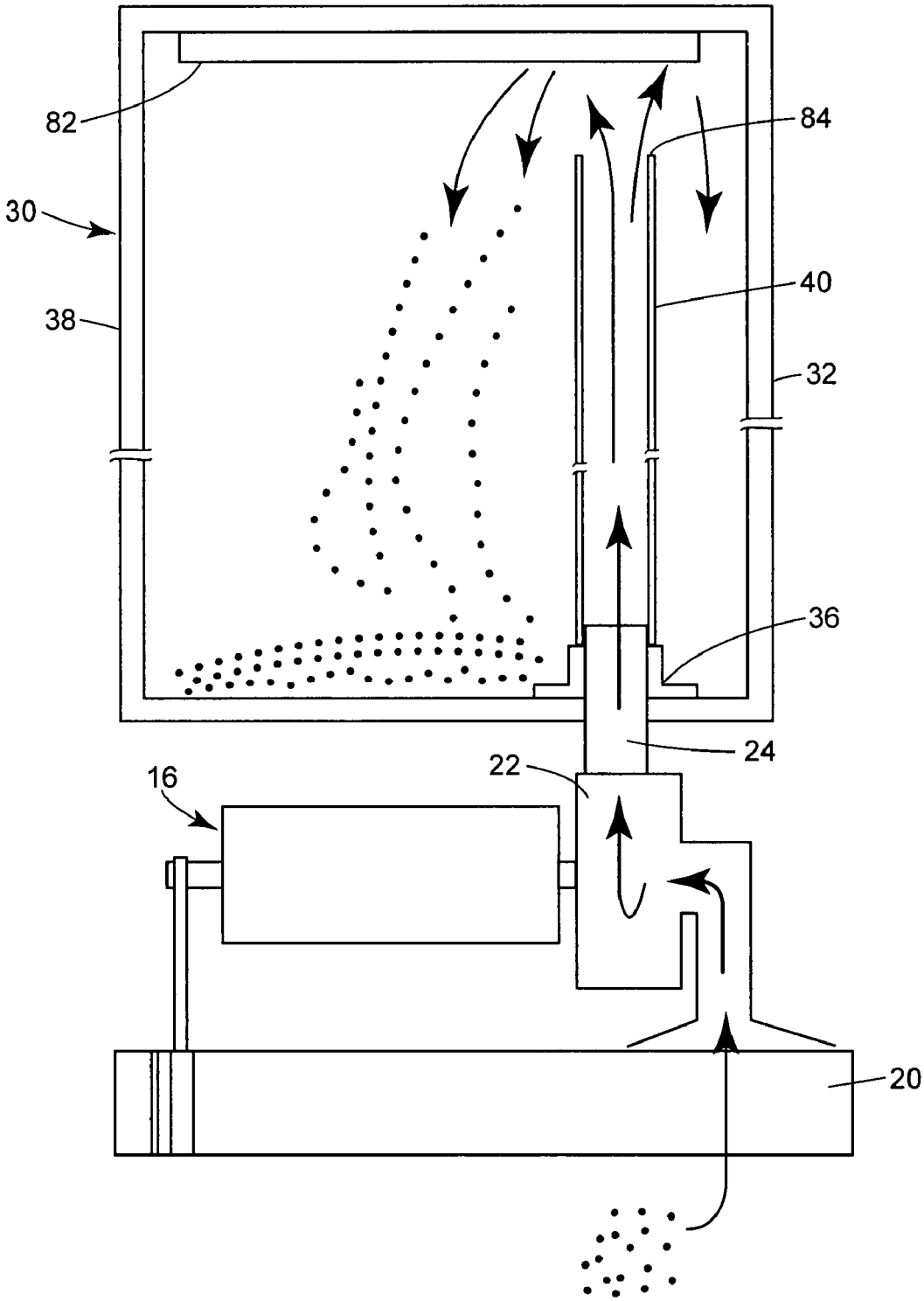
FIG. 2 is a schematic view of some of the components of the vacuum cleaner of FIG. 1.

Like many previously-known vacuum cleaner arrangements, the vacuum cleaner 10 seen in FIG. 1 has a cleaning head 12 and a handle 14. As seen in FIG. 2, the illustrated cleaning head has a motor 16 that drives an optional brush roll 20 that can be used to loosen dirt from a surface. The motor also drives an impeller 22 that sucks air and dirt from the area being cleaned and blows it through a duct 24 to a disposable bag 30. As seen in FIGS. 3-7, the bag has relatively large sides 32, a relatively small, generally planar base 34, and a collar 36 that engages the duct. The disposable bag may be contained within a protective outer cover 38 (FIG. 1), such as a conventional cloth bag. The illustrated impeller 22 is positioned upstream of the bag. In some circumstances, the impeller may be positioned downstream of the bag, so that clean air, rather than dirty air, passes through the impeller. In general, these features are conventional.

The illustrated vacuum 10 also has new features. As described in more detail below, the duct 24 leading to the disposable bag 30 is positioned near the floor, separate from the handle 14, and opens upwardly, rather than horizontally. The collar 36 is positioned on the base 34 of the bag, rather than on the sides 32 of the bag, leaving the sides continuous (i.e., free of inlet apertures). An elongated, light-weight tube 40 is disposed within the bag, and has a lower end 42 that is connected to the collar 36. Although the illustrated bag is generally box-shaped, other shapes are possible, including a tubular shape with a round or circular base and essentially one continuous side.

Figure 3:
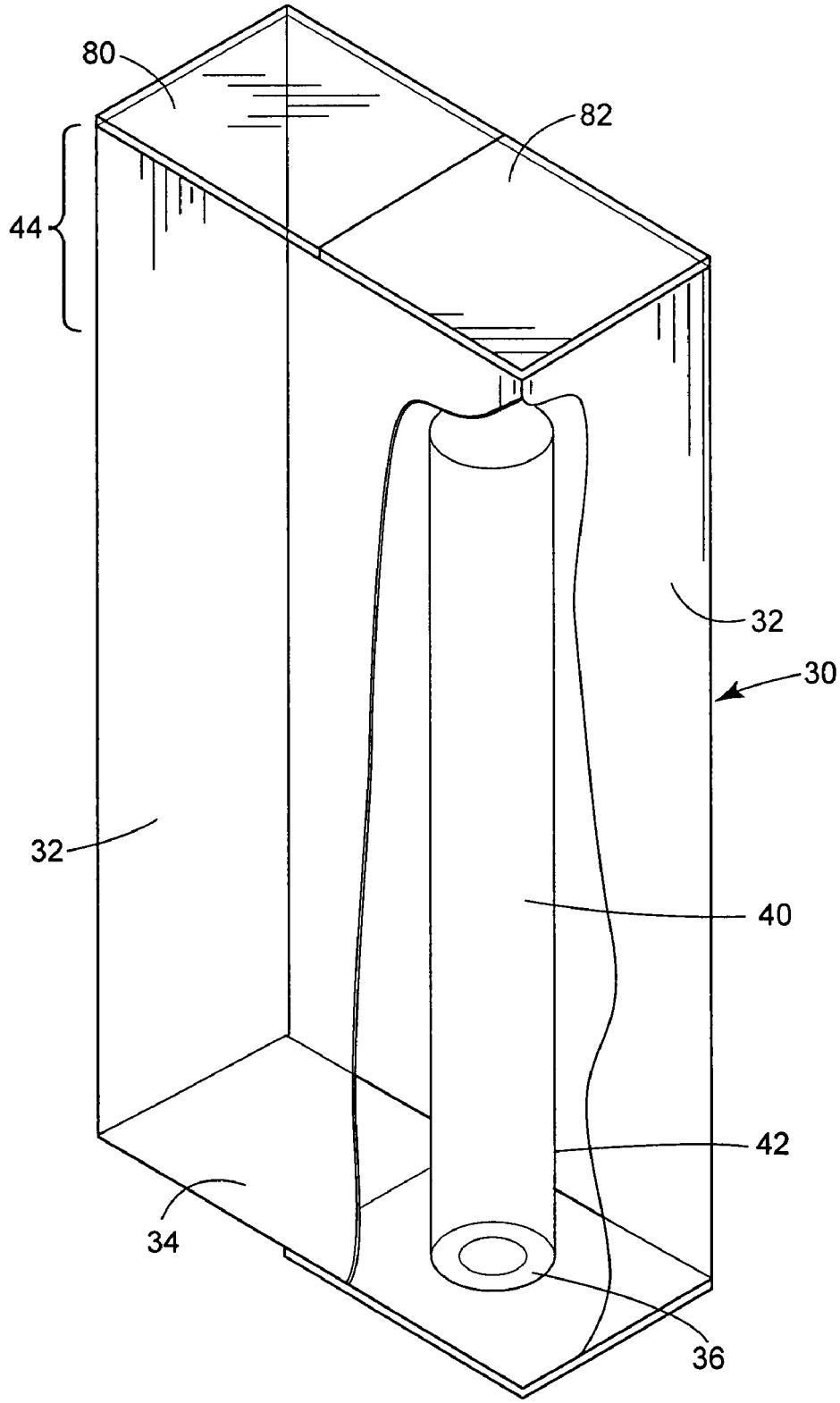
FIGS. 3 and 4 are perspective views of the disposable bag used in the vacuum cleaner of FIGS. 1 and 2.
Figure 4:
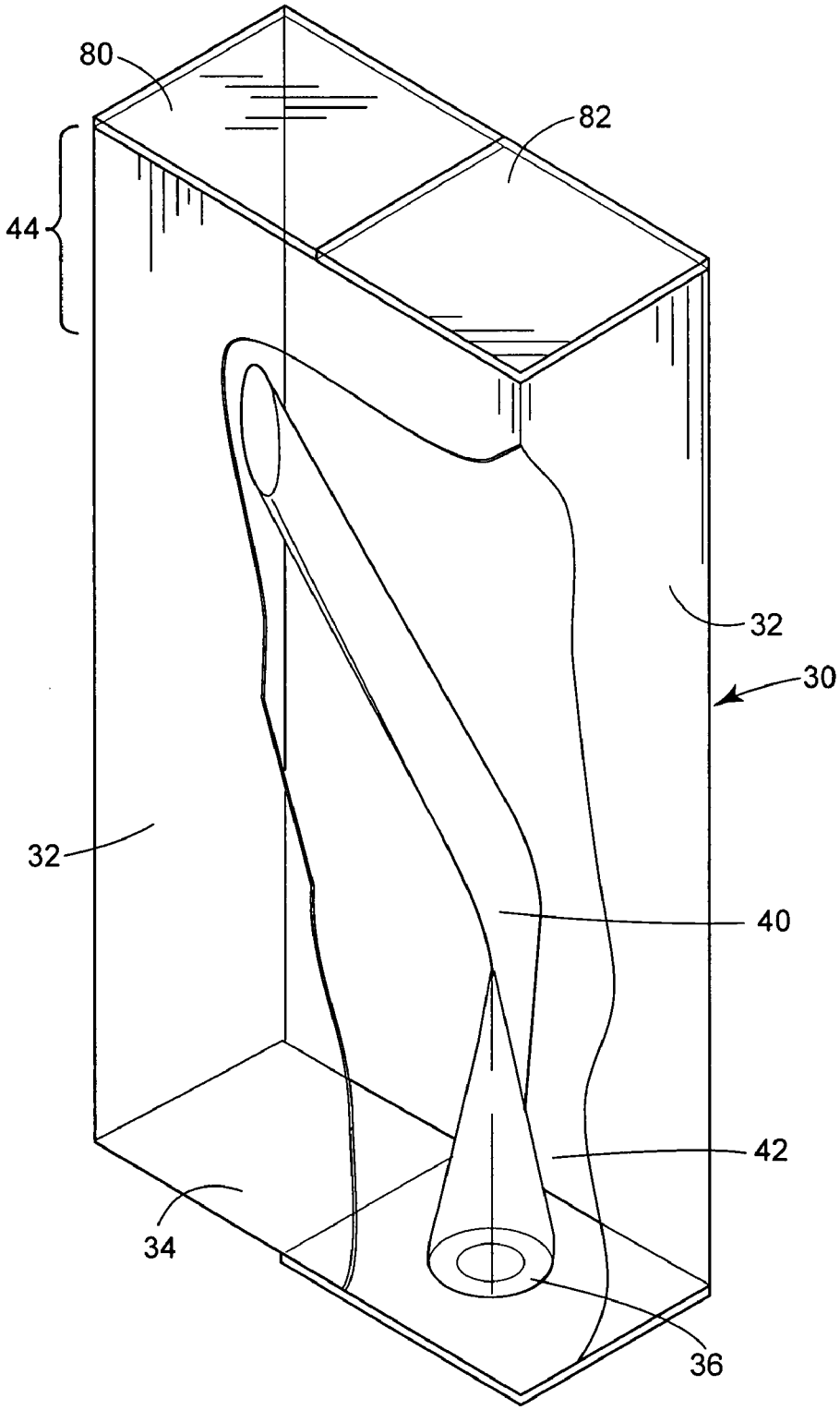
Figure 5:
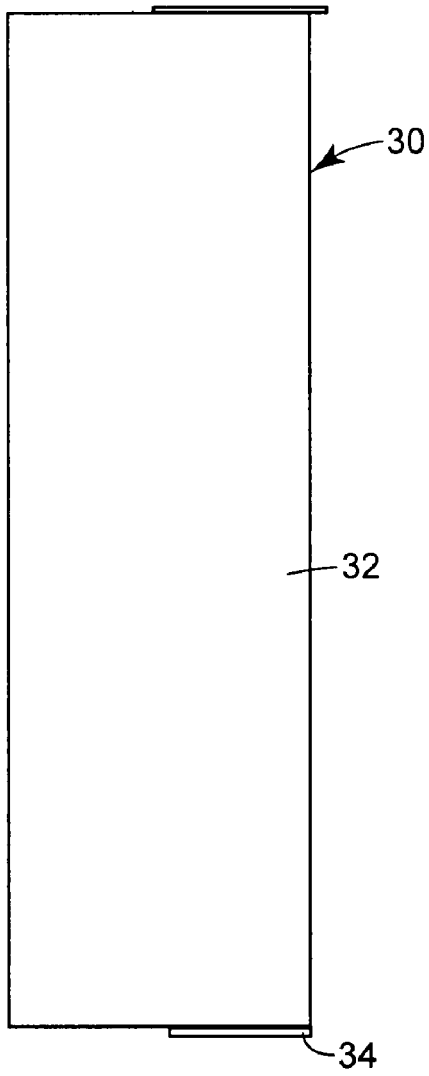
FIGS. 5 and 6 are front and side views of the bag.
Figure 6:
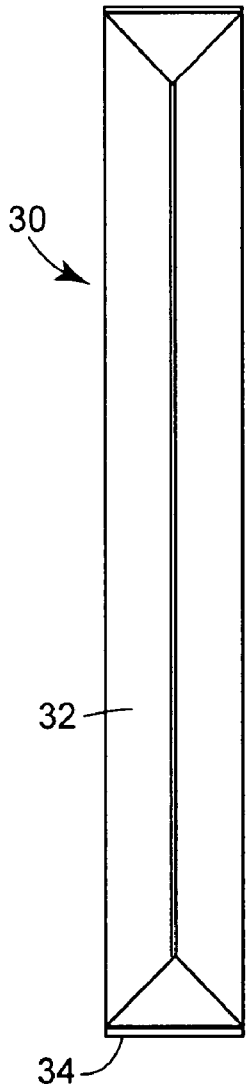
Figure 7:
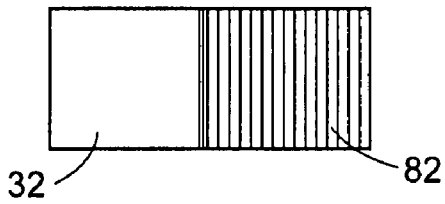
FIG. 7 is a top view of the bag.

As best seen in FIGS. 2-4, the illustrated tube 40 is disposed within the disposable bag 30, rather than outside the bag. Preferably, the tube is made of a flexible material that is collapsible and weighs less than ½ ounce per square foot. For example, 6-mil polyethylene lay-flat tubing that has opposed lateral creases can be used. Low weight can help to minimize the weight of vacuum, and collapsibility can facilitate the packaging and handling of empty bags. Both features can help to reduce the manufacturing cost of the bag.

Figure 10:
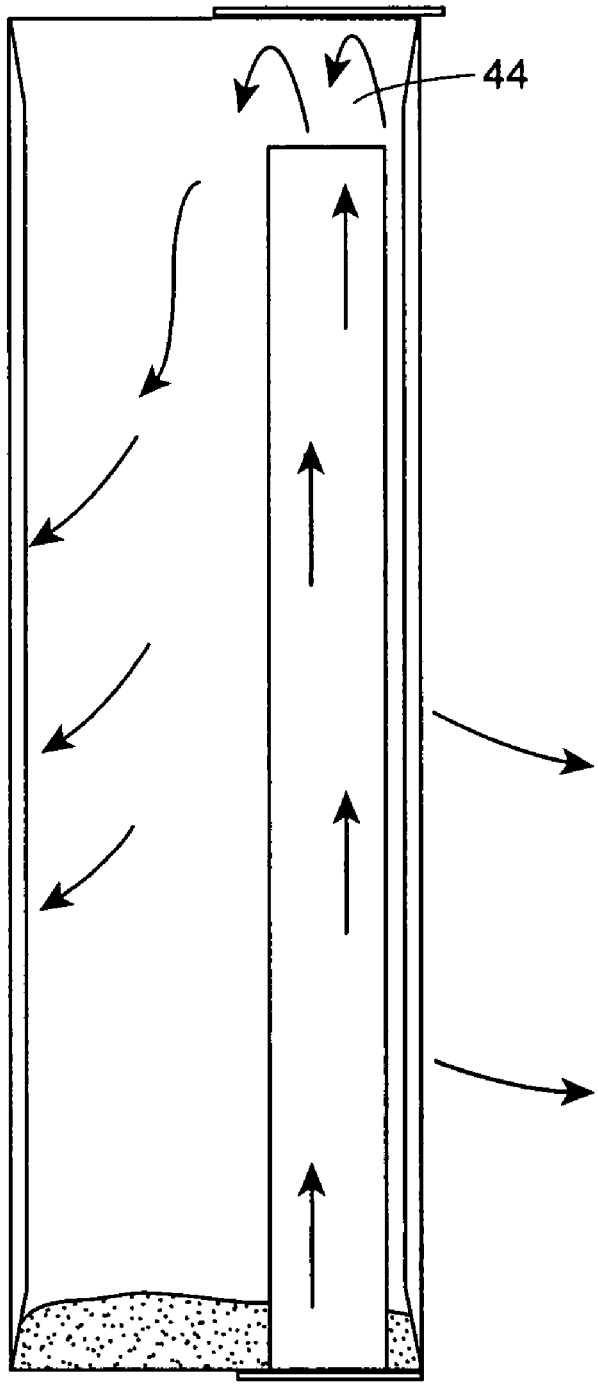
FIG. 10 is a cross-sectional view of the bag in use.
Figure 11:
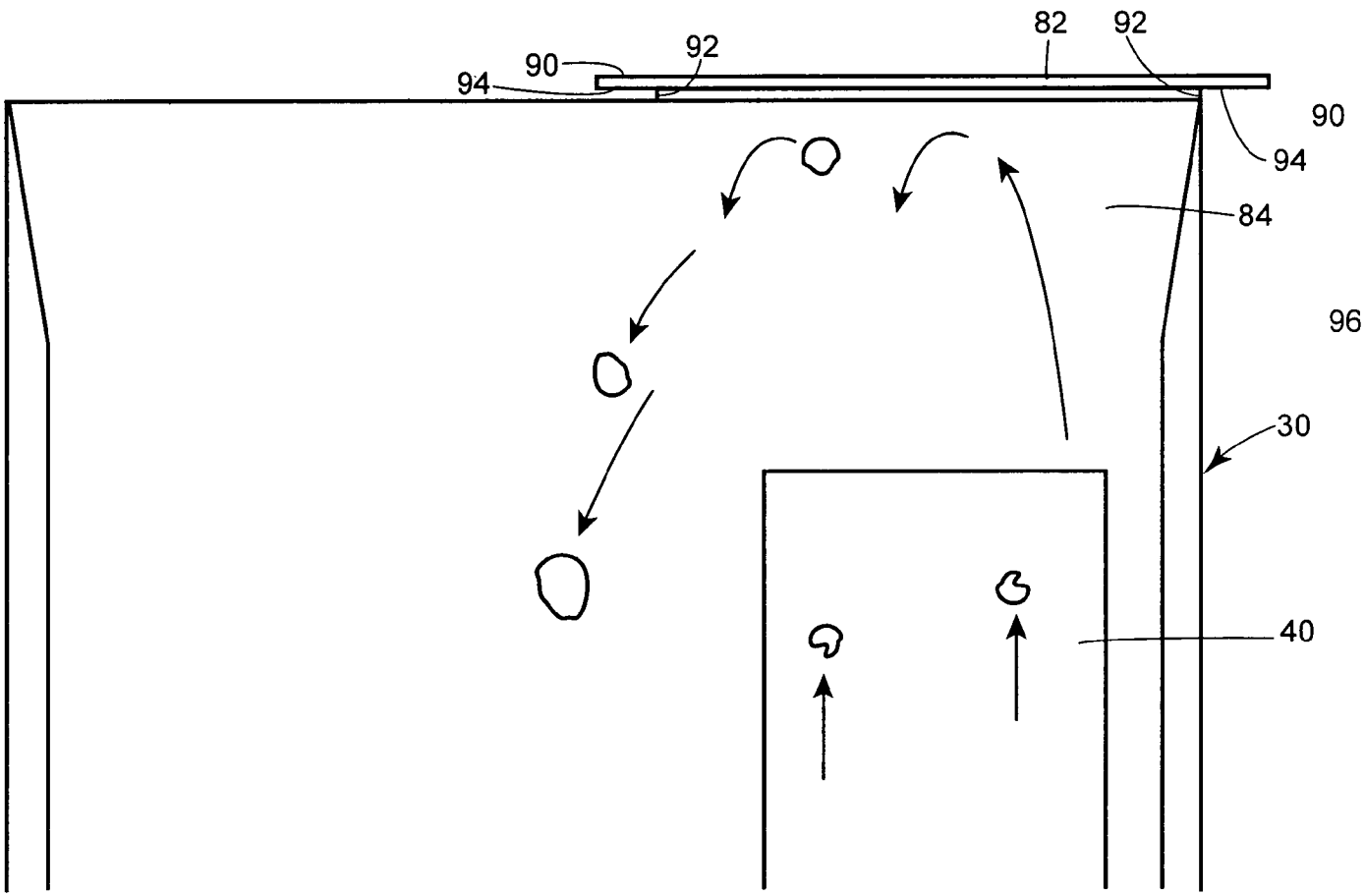
FIG. 11 is an enlarged fragmentary view of the upper portion of FIG. 8.

The illustrated tube 40 extends more than three-fourths of the way up the sides 32 of the bag 30, to within a few inches of the top 38 of the bag. While other tube lengths may also be useful in particular cases, it may be preferred for the length of the tube to be greater than half the height of the sides of the bag (FIG. 10). In some cases, this length can help to assure that dirty air is directed to an upper region 44 of the bag, where the dirt or dust is less densely packed. In addition, the tendency of lay-flat tubing to close (as seen in FIG. 4) when not forced open by airflow created by the impeller 22 may reduce the chance of collected dust falling back through the tube when the vacuum is turned off. Other tube arrangements, however, might also be used in appropriate circumstances.

As seen in FIG. 1, the illustrated duct 24 on the cleaning head 12 opens upwardly from a position near the floor. In many cases, it may be preferred to position the upper end of the duct no more than 8 inches above the floor, remote from and completely separate from the handle 14.

There are many ways to provide a suitable collar on the vacuum bag 30. In the arrangement illustrated in FIG. 5, the relatively planar base 34 of the bag 30 is sandwiched between an upper piece 54 of mounting material (such as cardboard) and a lower piece 72 of mounting material. Each of the pieces of mounting material has an aperture that fits over the duct 24, providing a collar 36. Of course, other arrangements can also be used, depending upon the circumstances.

Because the collar 36 is on the base 34 of the bag 30, rather than on the sides 32 of the bag, it may be desirable to provide a seal 70 on the collar to reduce the chance of dirt slipping out of the bag between the collar and the duct 24. The illustrated collar has a flexible seal in the form of an elastic sealing ring that is made of a flat rubber sheet with a central opening. The sheet is mounted between the layers of mounting material in the collar. The central opening in the sheet is smaller than the diameter of the duct, causing the sheet to seal against the outside of the duct when the collar is fitted over the duct. Other seal arrangements can also be used.

Figure 8:
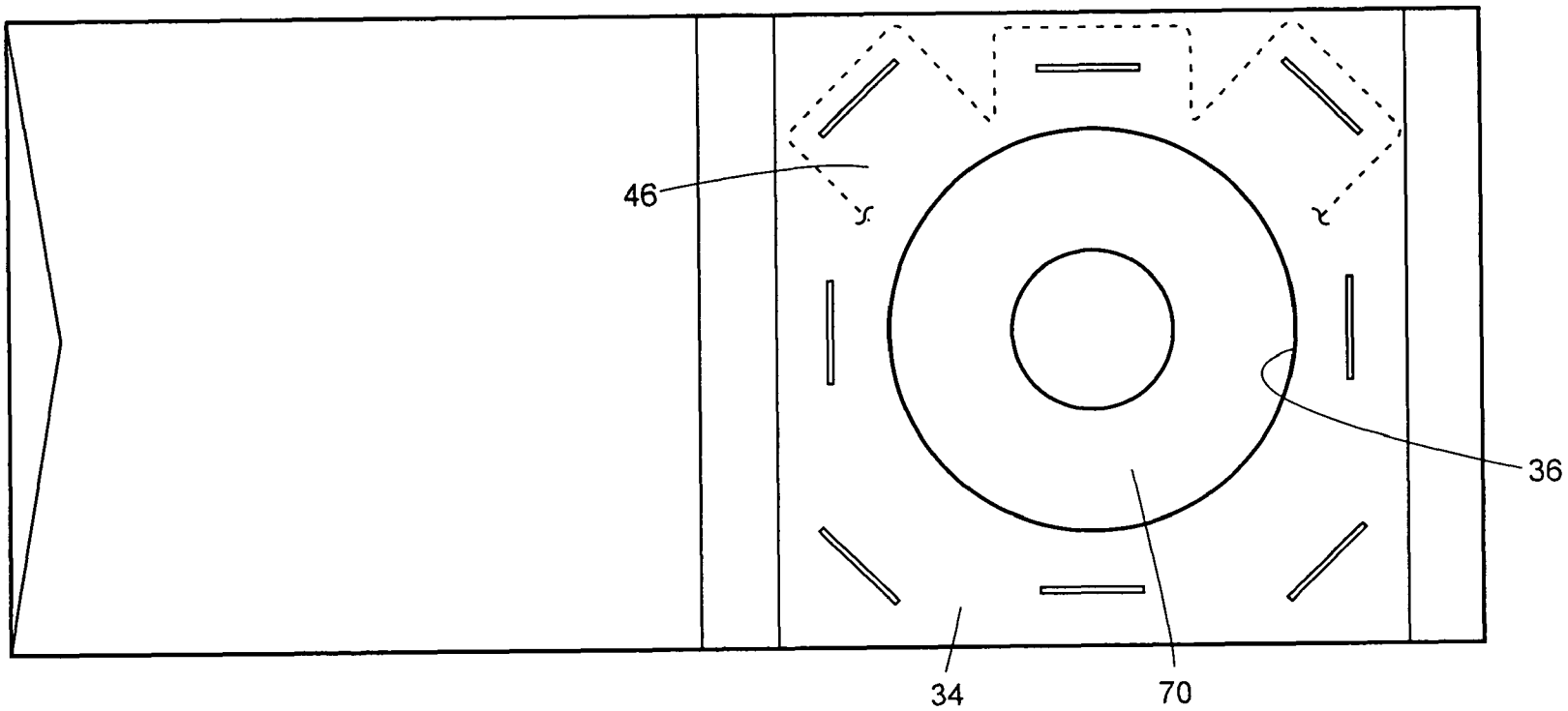
FIG. 8 is an enlarged bottom view of the bag.
Figure 9:
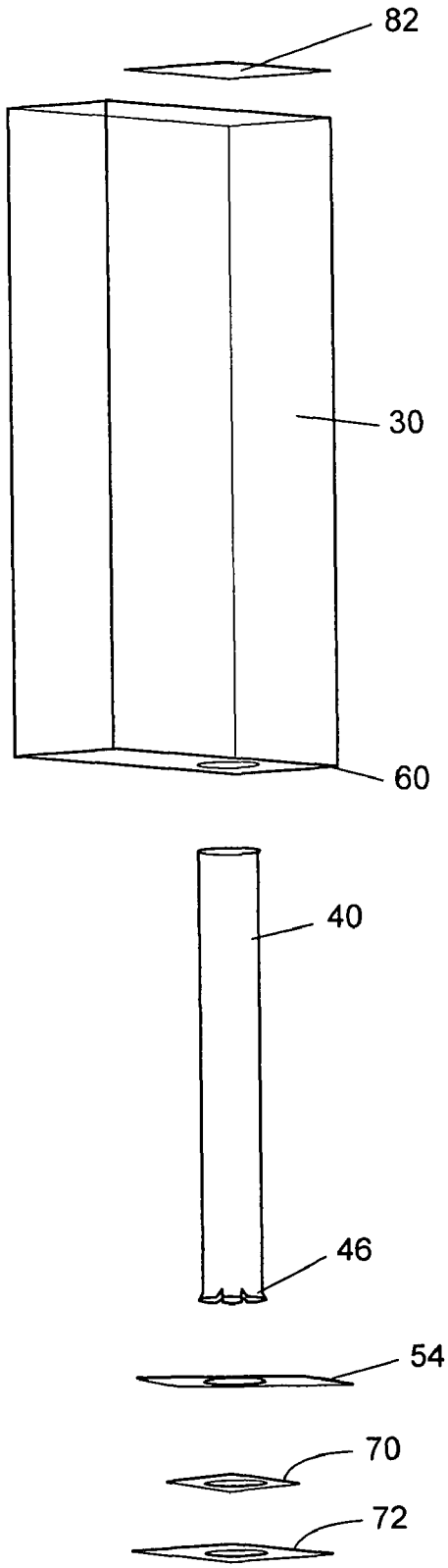
FIG. 9 is an exploded view of the bag.

The tube 40 can be secured to the collar 36 in a variety of ways. The illustrated tube is attached to the collar by tabs 46 (FIGS. 8, 9). The tabs are formed by shredding the lower end of the tube and folding the resulting tabs outwardly. In the illustrated embodiment of the invention, the tabs are stapled to the layers of mounting material. The tube can also be connected to the collar in other equivalent ways, such as by adhesives, by forming the collar integrally with the tube, or by heat staking the tube to a shoulder on the collar. Cardboard plate may be added over the staples for security, appearance, and air seal.

Because dirty air enters the illustrated bag 30 in an upward direction, rather than in a horizontal direction, there is a chance of increased wear or pressure on a portion of the top 38 of the bag. In some instances, therefore, it may be desirable to reinforce that portion of the top of the bag so that it is stronger than the sides 32 of the bag. In the illustrated arrangement, the top of the bag is reinforced with a cardboard support 82. The illustrated support is positioned above the open upper end 84 of the tube 40 and covers no more than about half of the top of the bag, directly above the upper end of the tube. This relatively small size of the support may leave the bag as a whole relatively flexible, making it easier (for example) to install or remove a bag through an opening in the protective outer cover 38.

Figure 12:
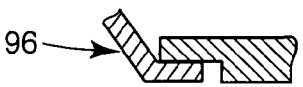
FIG. 12 is a detail view of one side of a support on the top of the bag.

The illustrated support is glued to the outer side of the top of the bag, and has flanges 90 that extend in opposite directions from shoulders 92 where the support is joined to the top of the bag. The extension of these flanges from the shoulders provide surfaces 94 that can engage arms 96 in the vacuum cleaner, enabling the bag to be suspended from the arms. One example of this is illustrated in FIG. 12. Other arrangements may be used in appropriate circumstances.

The disclosed bag arrangement reduces the distance air has to travel to reach the bag, and thus may provide better airflow characteristics within the vacuum cleaner. The potential problem of dirty air leaking through a bottom opening is addressed by the arrangement of the flexible tube.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A disposable bag that is for use with a vacuum cleaner and has:

one or more relatively large sides with a bottom edge;

a relatively small base that adjoins the bottom edge of the sides;

a collar on the base; and an elongated, light-weight, fully-collapsible tube that is disposed within the sides, and has a lower end that is permanently connected to the collar; and a reinforcing support that extends parallel to the base and covers no more than half the top of the bag.

2. A vacuum cleaner comprising:

a cleaning head;

an upward-opening duct on the head through which airflow from the head passes; and a disposable bag that has one or more relatively large sides with a bottom edge, a relatively small base that adjoins the bottom edge of the sides, a collar on the base that detachably engages the duct on the cleaning head, and an elongated, light-weight, fully-collapsible tube that is made of lay-flat tubing, is disposed within the sides of the disposable bag, and has a lower end that is permanently connected to the collar of the disposable bag.

3. A vacuum cleaner as recited in claim 2, in which the base is generally planar.

4. A vacuum cleaner as recited in claim 2, in which the bag has a reinforced top that extends parallel to the base.

5. A vacuum cleaner as recited in claim 2, in which the bag is reinforced with a support that extends parallel to the base and covers no more than half the top of the bag.

6. A disposable bag that is arranged for use with a vacuum cleaner and has:

one or more relatively large sides with a bottom edge;

a relatively small base that adjoins the bottom edge of the sides;

a collar on the base;

an elongated, light-weight, fully-flexible tube that is made of polyethylene, is permanently connected to the collar, and is permanently disposed within the bag; and a reinforced top that extends parallel to the base when the bag is used.

7. A disposable bag as recited in claim 6, in which the base is generally planar.

8. A disposable bag as recited in claim 6, in which the tube is made of lay-flat tubing.

9. A disposable bag as recited in claim 6, in which the bag is reinforced with a support that covers no more than half the top of the bag.

* * * * *